US006371036B1

(12) United States Patent
Ho

(10) Patent No.: US 6,371,036 B1
(45) Date of Patent: Apr. 16, 2002

(54) INDUSTRIAL-USE SEWING MACHINE STRUCTURE WITH TRANSVERSE TUBE-SHAPED NEEDLE PLATE BASE FOR MAKING HIGH-SPEED HERRINGBONE STITCH

(76) Inventor: Tsai-Fa Ho, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/834,631

(22) Filed: Apr. 16, 2001

(51) Int. Cl.[7] ..... D05B 27/24
(52) U.S. Cl. ..... 112/323
(58) Field of Search ..... 112/220, 323, 112/324, 470.29

(56) References Cited

U.S. PATENT DOCUMENTS 1,581,524 A * 4/1926 Wardwell ..... 112/323
1,927,489 A * 9/1933 Clayton ..... 112/323
2,526,480 A * 10/1950 Hohmann ..... 112/323
4,469,039 A * 9/1984 Marchesi ..... 112/323

* cited by examiner

*Primary Examiner*—Ismael Izaguirre

(57) ABSTRACT

The invention herein relating to an industrial-use sewing machine structure with transverse tube-shaped needle plate base for making high-speed herringbone stitch mainly consists of a structure of a horizontally oriented and vertically extended transverse tube-shaped fabric feed needle plate base disposed below the needle holder of the sewing machine and, furthermore, a drive mechanism with the drive revolving shuttle and the fabric feed tooth plate situated in the interior section for making variation in the type of stitch along with the style of the pattern cam of the sewing machine main body and for wider applications on sewing the objects being processed in the forms of tube, ring or arc, and is capable of not only increasing the sturdier sewing and attractive appearance of the objects being processed by making the variations of the herringbone stitches, but also enhancing the product quality and added value of the productivity of sewing machines in this category.

5 Claims, 9 Drawing Sheets

INDUSTRIAL-USE SEWING MACHINE STRUCTURE WITH TRANSVERSE TUBE-SHAPED NEEDLE PLATE BASE FOR MAKING HIGH-SPEED HERRINGBONE STITCH

BACKGROUND OF THE INVENTION

1. Field of the Invention

The invention herein aims to provide a sewing machine, with a structure of a horizontally oriented and vertically extended transverse tube-shaped fabric feed needle plate base disposed below the needle holder of the sewing machine and a drive mechanism with the drive revolving shuttle and the fabric feed tooth plate situated in the interior section; with the modifications afforded by the said drive mechanism, the size of the interior section of the fabric feed needle plate base can be reduced to a narrow tube beam-shape for making variation in the type of stitch along with the style of the pattern cam of the sewing machine main body, capable of not only increasing the sturdier sewing and attractive appearance of the objects being processed, but also enabling the sewing machines industry to create and enhance the product quality and the added value of the productivity.

2. Description of the Prior Art

Referring to FIG. 8, an isometric drawing of the external view of a conventional level platform-type sewing machine structure, wherein, the sewing machine (B) has disposed at its bottom section (below the needle holder (B6)) a level platform-type fabric feed needle plate base (B7) structure and, as indicated in FIGS. 1 and 2, a dog base plate (B71) is situated at the interior section of the fabric feed needle plate base (B7) which facilitates the installation of a fabric feed dog (B72) at the top section of the dog base plate (B71), and since one end of the dog base plate (B71) is conjoined to an eccentric shaft (B11) at the end tail of another main shaft (B1') on the bottom panel via a connecting rod (B73), and the other end is conjoined to a rocker arm (B74), therefore, when the main shaft (B1') on the bottom panel is driven by the belt (C) and rotates along with the main shaft (B1), this initiates the repeated movement of the dog base plate (B71) following path shown in FIG. 3 and furthermore, there is a press foot (B75) at the upper extend of the fabric feed needle plate base (B7), when the dog base plate (B71) ascends, the fabric feed dog (B72) and the press foot (B75) grasp the object being processed (D) between them such that the object being processed (D) becomes taut, at which time, the fabric feed dog (B72) moves forward and backward (in the direction of the operator) along with the dog base plate (B71), and after the object being processed (D) is pulled a given distance, the dog base plate (B71) descends and releases the object being processed (D), and then the dog base plate (B71) moves forward and backward to the other side such that when the dog base plate (B71) ascends once again and contacts the object being processed (D), the repetitive said routine completes the sewing action of the needle holder (B6); furthermore, a pattern cam (A) structure is situated inside the head section of the sewing machine (B), and the pattern cam (A) is mainly coupled to a transverse main shaft (B1) and rotates along with the main shaft (B1); an idler wheel fixture (B3) rests against the pattern cam (A) and is linked to a needle holder fixture (B5) via a connecting rod (B4) such that when the main shaft (B1) of the sewing machine (B) rotates and drives the needle holder (B6) upward and downward, the pattern cam (A) is thus driven by the transverse shaft (B2) to rotate and cause the idler wheel fixture (B3) to swing following the sinusoidal surface of the pattern cam (A) and to drive the connecting rod (B4) to repeatedly push the needle holder fixture (B5) leftward and rightward, while the needle holder (B6) of the sewing machine (B) moves upward and downward to sew the object being processed (D) to collectively generate a left and right transverse movement and thereby effectively accomplish a variable herringbone stitch as the object being processed (D) is conveyed straight ahead.

In addition, a revolving shuttle (B8) structure is disposed within the interior section of the fabric feed needle plate base (B7), the revolving shuttle (B8)is mainly connected by a drive mechanism (B81) to rotation along with the main shaft (B1') such that as the needle holder (B6) descends, the threads in the inner section of the revolving shuttle (B18) and in the sewing needle (B61) at the bottom end of the needle holder (B6) can conduct a stitching routine that achieves the purpose of sewing the object being processed (D); furthermore, since for adapting to the pattern cam (A) varying the sewn stitching situated inside the fabric feed needle plate base (B7) of the said conventional sewing machine, the drive mechanism disposed within the interior section occupies a space of considerably larger dimensions and, furthermore, in order to drive along with the other main shaft (B1') on the bottom panel, only a level platform-type design arrangement can be accommodated; however, with regard to the physical characteristic of the object being processed, the level platform-type fabric feed needle plate base does not have positions for a completely flat posturing and cannot be utilized for sewing and finishing irregularly contoured items such as the shapes of tube, arc and pocket of the sleeves or the pants; that interrupts the continuous operation of sewing the object being processed and not only is incapable of effectively maintaining product quality, but leads to decreased productivity as well as product quality.

SUMMARY OF THE INVENTION

Therefore, the invention herein, with a horizontally oriented and vertically extended transverse tube-shaped fabric feed needle plate base disposed below the needle holder of the sewing machine and, furthermore, a drive mechanism with the drive revolving shuttle and the fabric feed tooth plate situated in the interior section of the transverse tube-shaped fabric feed needle plate base for making variation in the type of stitch along with the style of the pattern cam of the sewing machine main body and not only for embellishing the objects being processed in the forms of tube, ring, arc and pocket, but also for effectively increasing the sturdier sewing, attractive appearance and the embellishment of the objects being processed through the variations of the herringbone stitches to enhance the product quality and added value of the productivity of sewing machines in this category, takes this as its primary objective.

Another objective of the invention herein is the inclusion of a cam situated at the tail end on the lower sub shaft and, furthermore, a horizontally oriented slot is formed on the bottom section of the dog base plate for an insertion fastening with the cam; the dog base plate also vertically inserted to a sliding block base of a connecting rod set, one of the ends of the sliding block base is conjoined to a swing arm via a connecting rod such that as the lower sub shaft rotates, the dog base plate moves upward and downward through the rotation of the cam, at which time, the sliding block base swings forward and backward through the link of the swing arm, the dog base plate slides upward and downward as well as swings forward and backward following the movement of the cam and the sliding block base; furthermore, the fabric feed dog is situated at the top section of the dog base plate such that as the dog base plate moves, it enables the fabric feed dog on the top section to accomplish the fabric feeding movement, and the fabric feed structure of the original level platform-type fabric feed plate base can be extended into the interior section of the transverse tube-shaped-shaped fabric feed needle plate base embodiment of the present invention.

Yet another objective of the invention herein is the inclusion of a drive shaft directly linked to the drive mechanism of the tube base, and by disposing a gear set at the tail end on the drive shaft and through the meshing among all the gears and the revolving shuttle, the revolving shuttle can be driven directly to rotate, and the revolving shuttle structure of the original level platform-type fabric feed plate base can be extended into the interior section of the transverse tube-shaped fabric feed needle plate base embodiment of the present invention.

To enable a further understanding of the features and the objectives of the invention herein, the brief description of the drawings below is followed by the detailed description of the preferred embodiment.

BRIEF DESCRIPTION OF THE DRAWINGS

FIG. 3 (B) is an isometric drawing of the dog base plate operation path inside a conventional level platform-type fabric feed needle plate base.

DETAILED DESCRIPTION OF THE PREFERRED EMBODIMENTS

Figure 1:
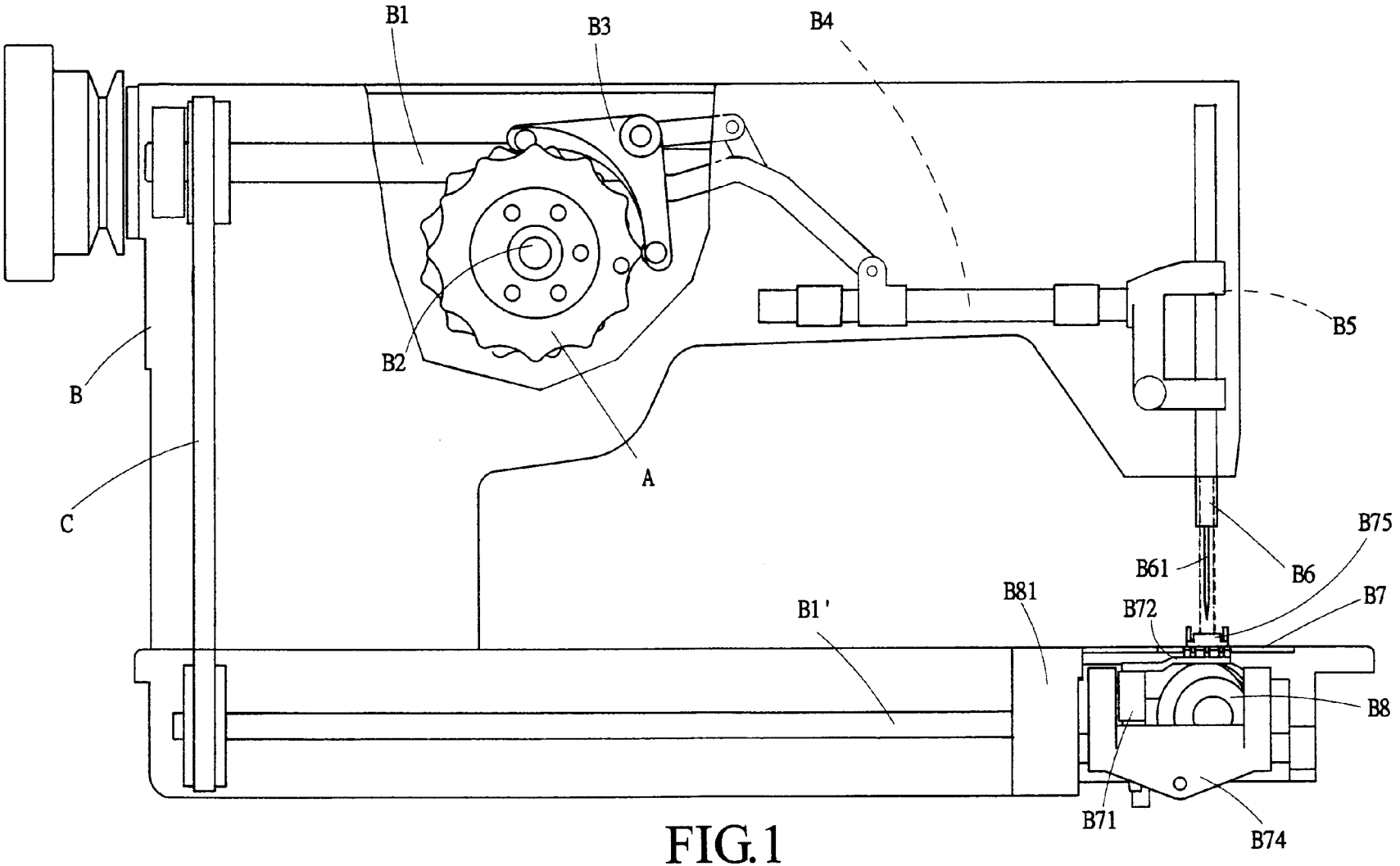
FIG.1 Prior Art
FIG. 1 is an isometric drawing of the conventional sewing machine with a pattern cam structure as viewed from the rear lateral side.
Figure 2:
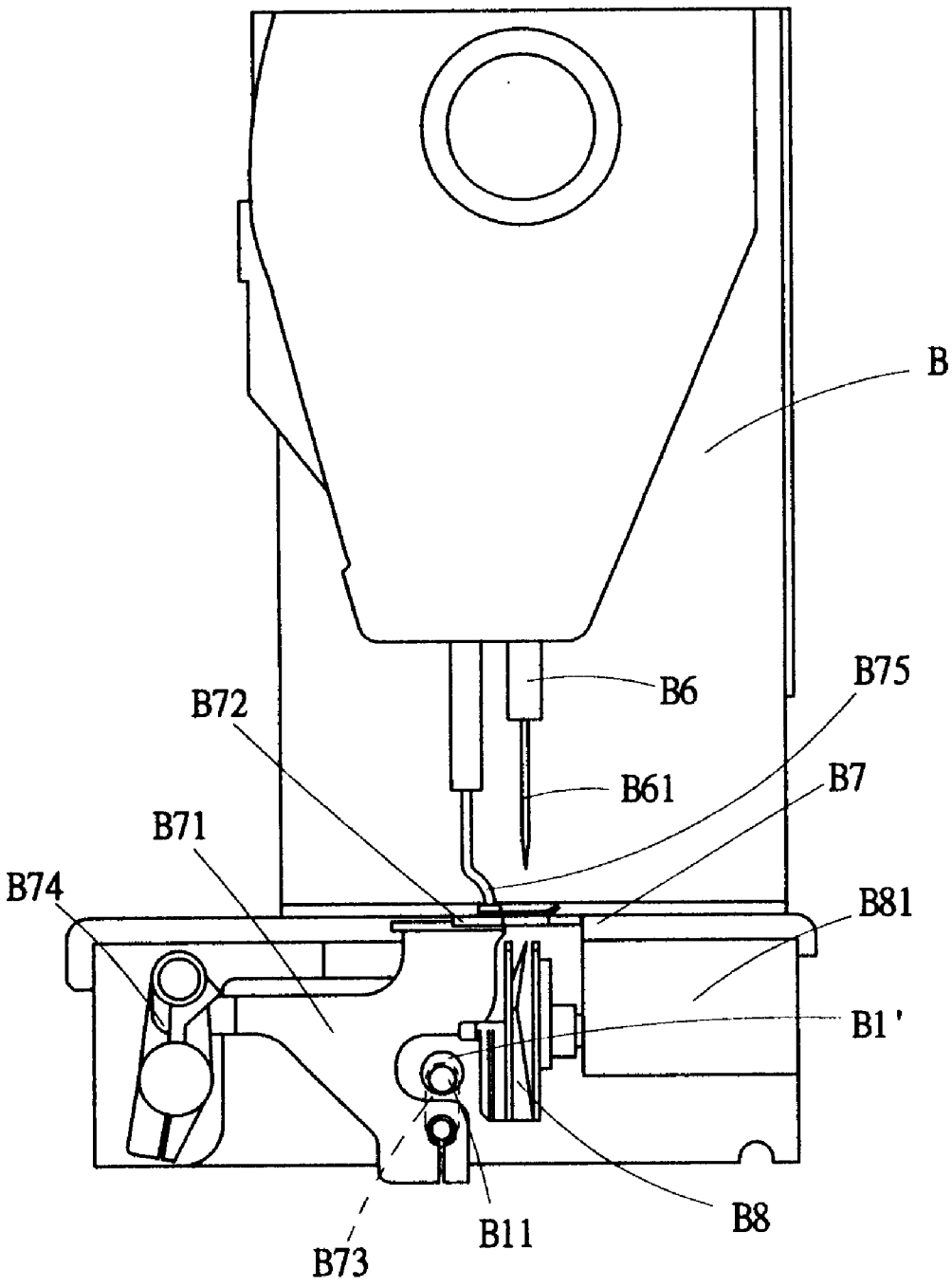
FIG.2 Prior Art
FIG. 2 is an isometric drawing of FIG. 1 as viewed from the perspective of the operator at the left lateral side.
Figure 3A:
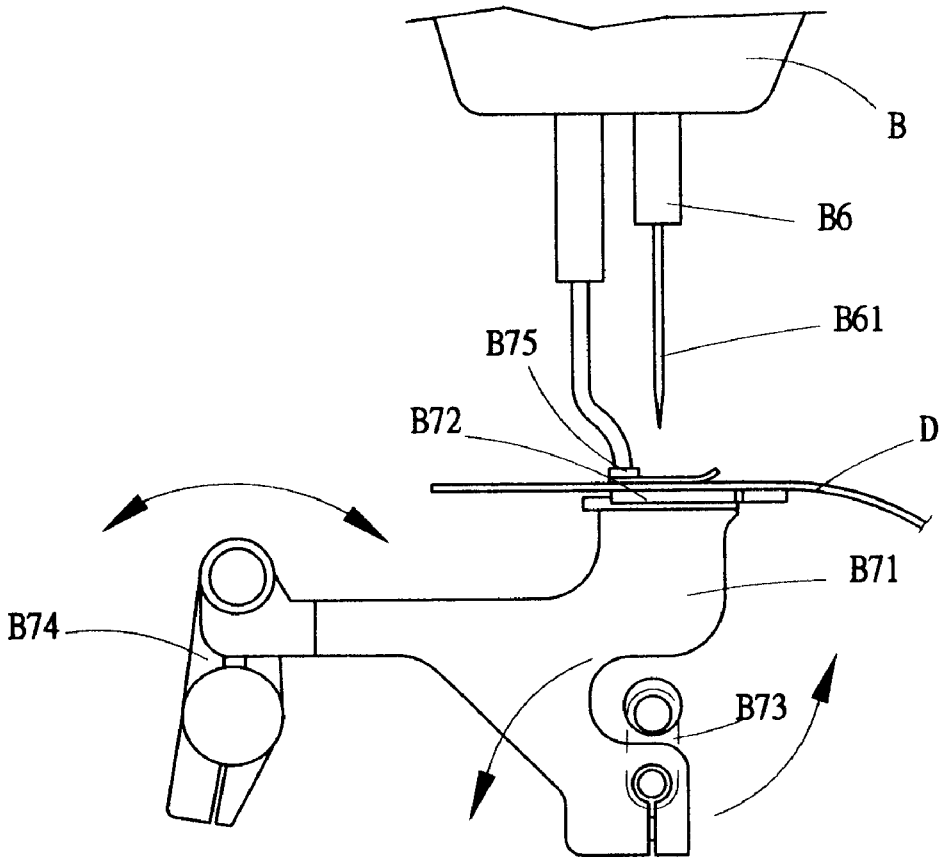
FIG.3(A) Prior Art
FIG. 3 (A) is an isometric drawing of the dog base plate structure inside a conventional level platform-type fabric feed needle plate base.
Figure 3B:
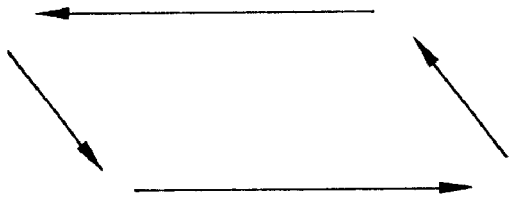
FIG.3(B) Prior Art
Figure 4:
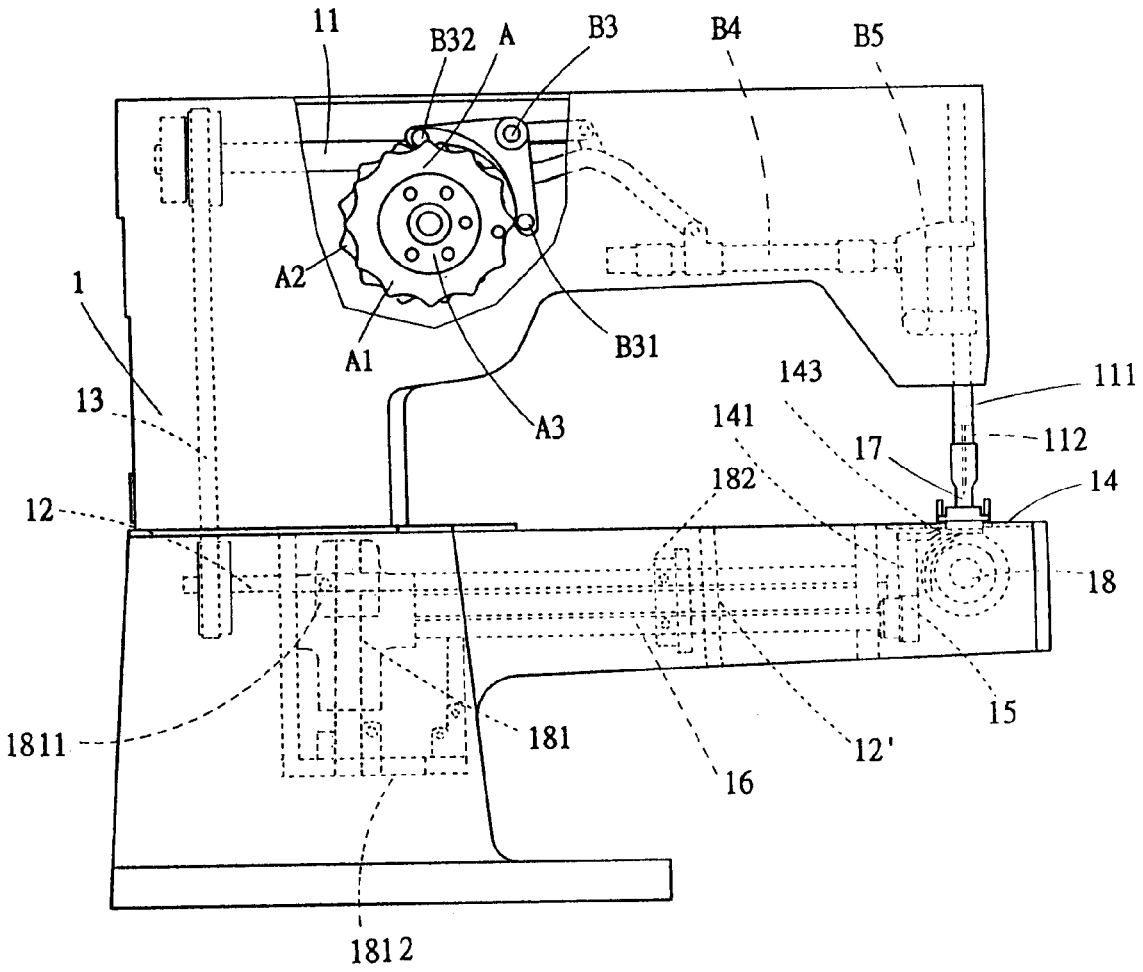
FIG. 4 is a cross-sectional drawing of the industrial-use sewing machine structure with transverse tube-shaped needle plate base for making high-speed herringbone stitch of the invention herein as viewed from a rear perspective.
Figure 5:
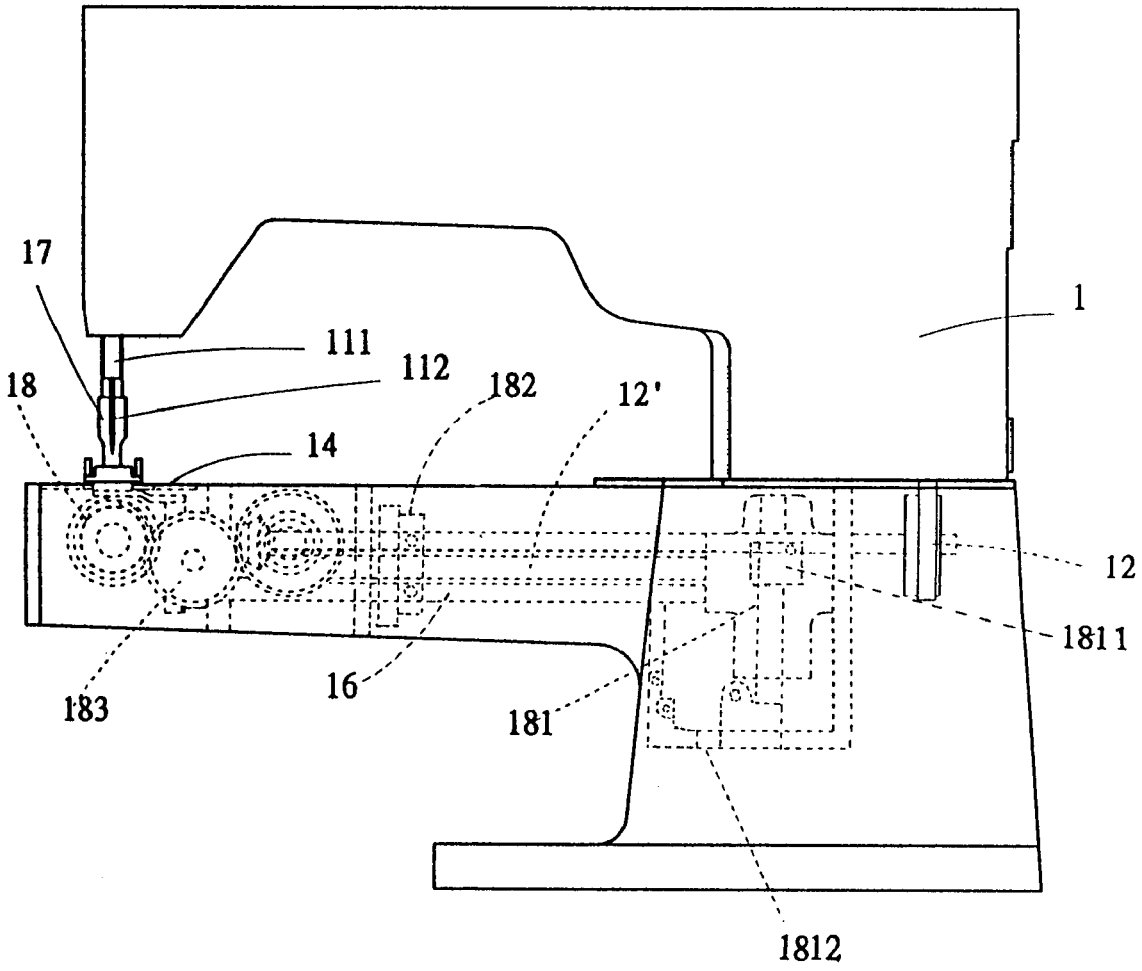
FIG. 5 is a cross-sectional and orthographic drawing of the industrial-use sewing machine structure with transverse tube-shaped needle plate base for making high-speed herringbone stitch of the invention herein.

The basic structure of the invention herein, as indicated in FIGS. 4 and 5, consists of a pattern cam (A) situated inside the head section of the sewing machine (1) that causes a leftward and rightward transverse motion of the needle holder (111) and the production of variable herringbone stitches as an object being processed is conveyed straight ahead; of which, the pattern cam (A) mainly consists of two pattern plate elements (A1, A2) in a stacked arrangement having a series of lobes and troughs proceeding curvilinearly along their circumferences, with a pattern mounting base (A3) at their central areas to facilitate the insertion fastening of the pattern cam (A) structure to a transverse shaft, and the driving between the transverse shaft and an upper main shaft (11) of the sewing machine (1) is done by a worm shaft and a worm wheel, such that when the upper main shaft (11) moves, the transverse shaft worm wheel is brought into motion by the upper main shaft (11) and thereby rotates the pattern cam (A); furthermore, a forked idler wheel fixture (B3) is situated on the edge of the pattern cam (A), and an eccentric idler wheel (B31) and an additional idler wheel (B32) on the two prongs of the idler wheel fixture (B3) rest against the two pattern plate elements (A1, A2), respectively; furthermore, a connecting rod (B4) at one end of the idler wheel fixture (B3) is linked to a needle holder fixture (B5) such that when the upper main shaft (11) of the sewing machine (1) is rotating and causes the needle holder (111) to move upward and downward, the pattern cam (A) is brought into rotation by the transverse shaft and further causes the idler wheel fixture (B3) to swing following the sinusoidal surface of the pattern cam (A) and drives the needle holder fixture (B5) to move in reciprocating transverse manner, as a result, while the needle holder (B6) of the sewing machine (1) is traveling up and down during the stitching of an object being processed, it is also moving transversely in alternating directions, thereby effectively producing a herringbone stitch as the object being processed is conveyed straight ahead; since herringbone stitch can increase the sewing effect for the object being processed, it is usually applicable in sewing and processing the laces and the fabric surface or for items in that seams do not have to overlaid and, therefore, traces of sewing are not apparent.

Figure 6:
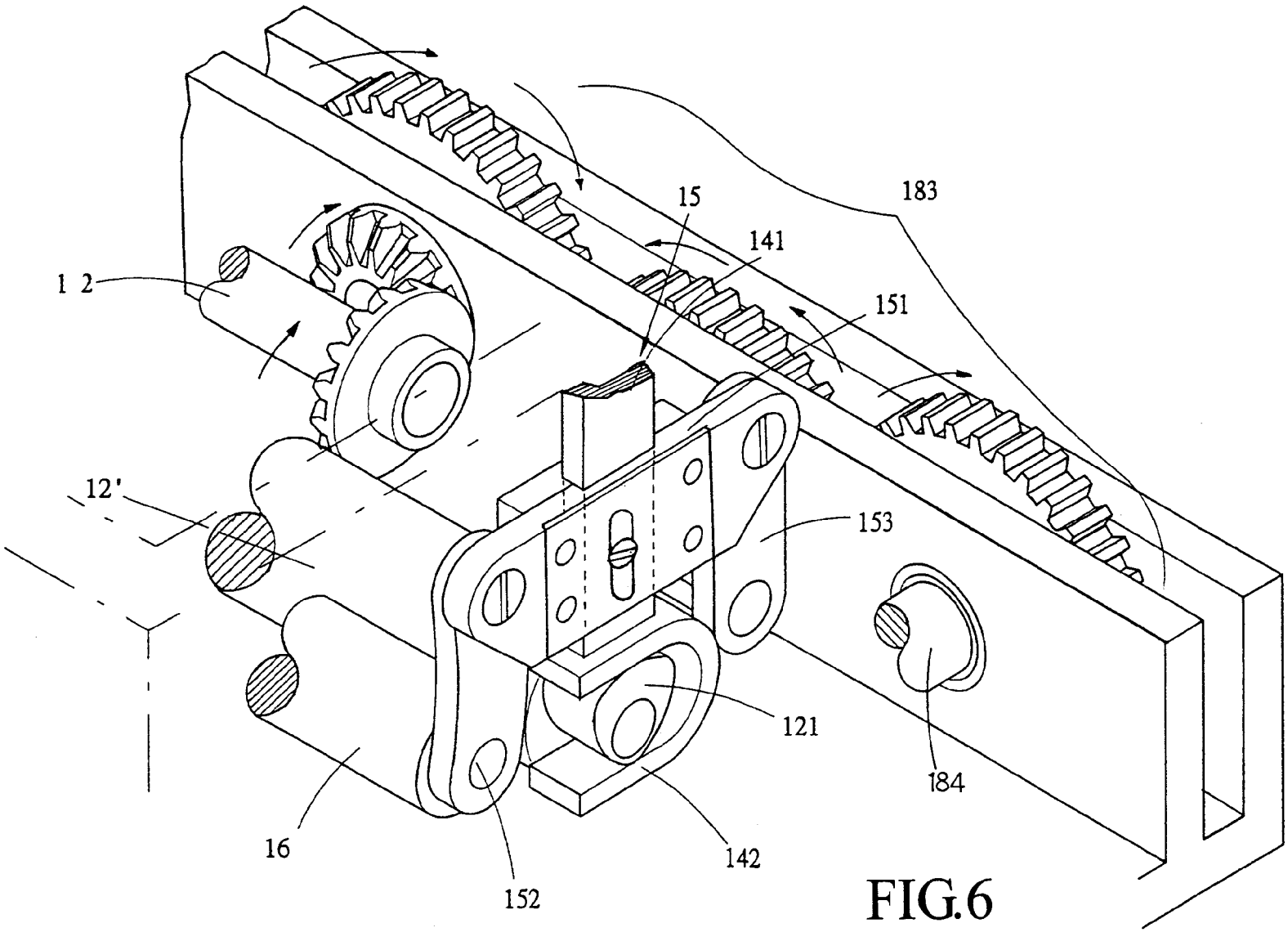
FIG. 6 is a pictorial drawing of the drive mechanism of the dog base plate and the connecting rod set of the invention herein.
Figure 7:
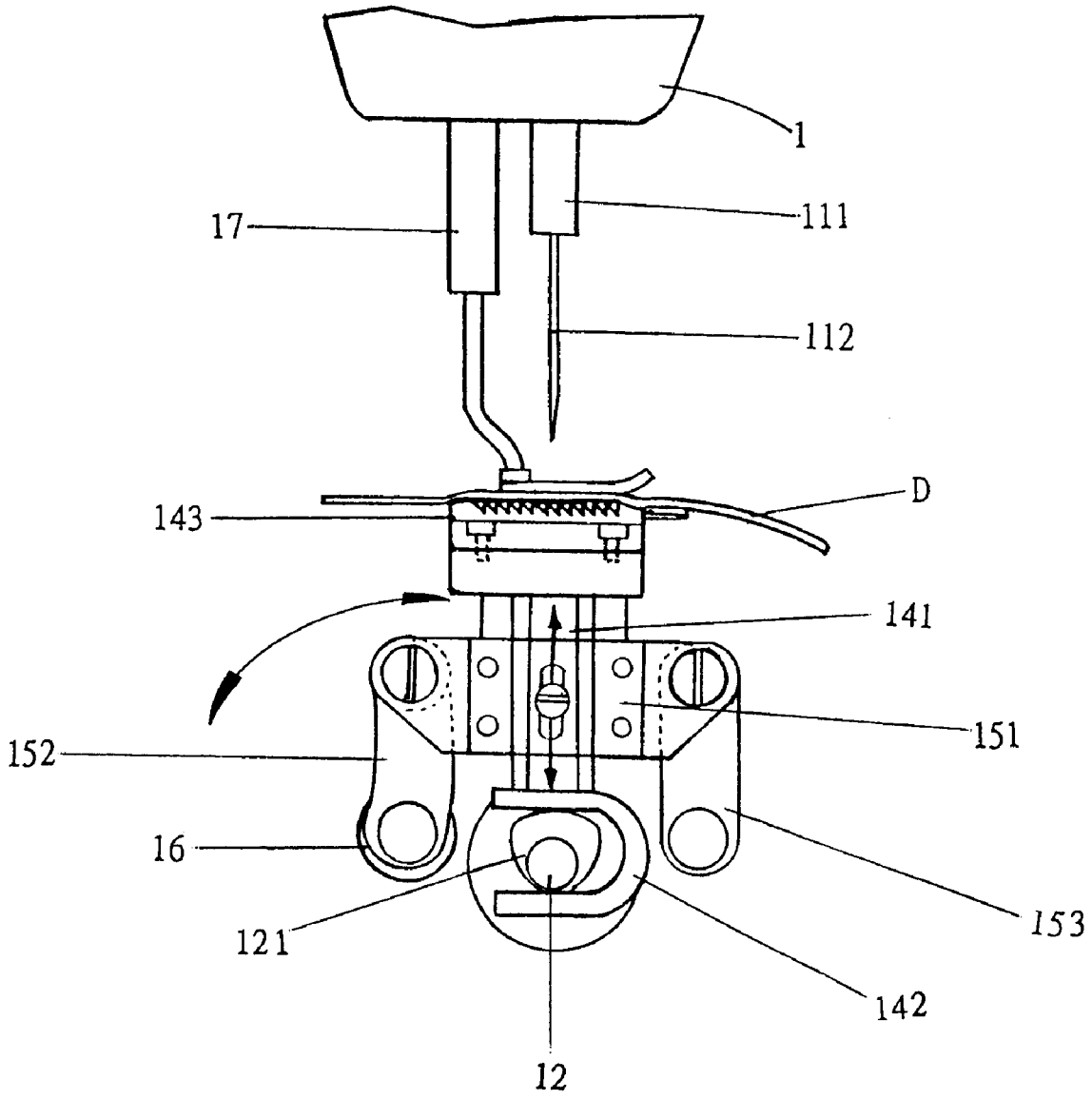
FIG. 7 is an isometric drawing of the movement of the dog base plate of the invention herein.
Figure 9:
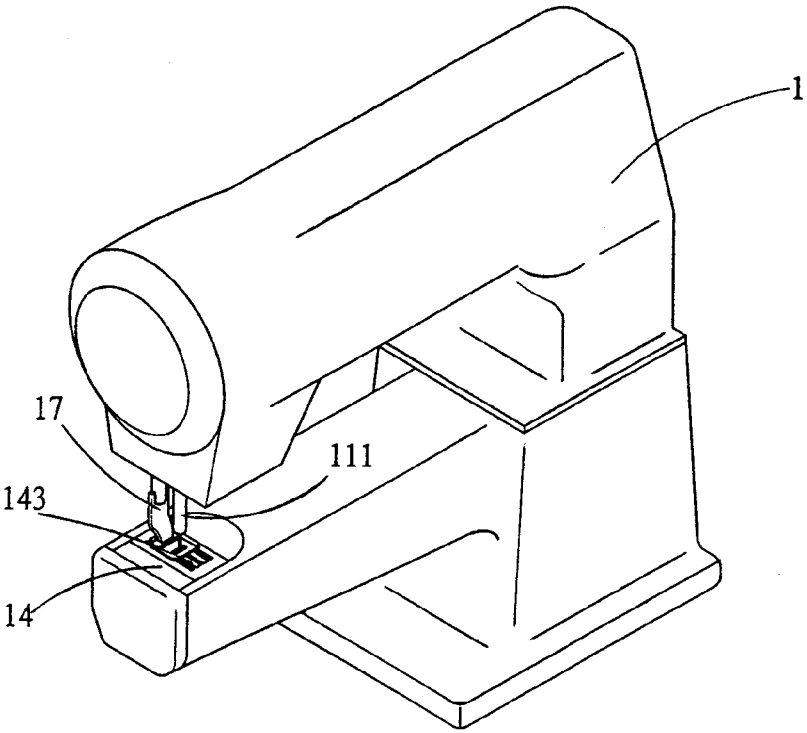
FIG. 9 is an isometric drawing of the external view of the industrial-use sewing machine with transverse tube-shaped needle plate base for making high-speed herringbone stitch.
Figure 8:
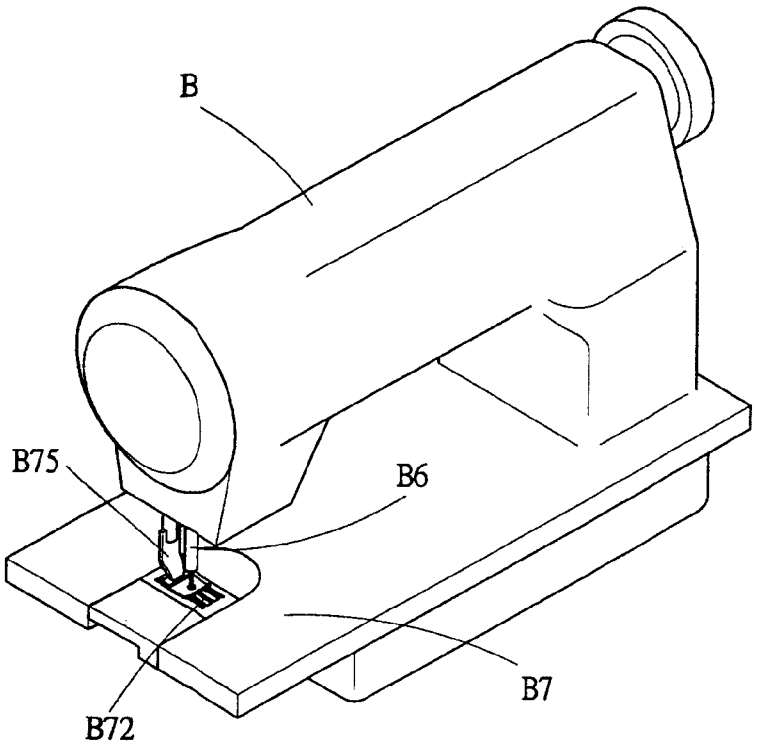
FIG.8 Prior Art
FIG. 8 is an isometric drawing of the external view of the conventional sewing machine with level platform-type fabric feed needle plate base.

At the bottom section (below the needle holder (111)) of the sewing machine (1) is a fabric feed plate base (14) structure, and situated in the interior section of the fabric feed plate base (14) is a dog base plate (141) which facilitates the installation of a fabric feed dog (143) at the top section of the dog base plate (141), while the bottom end of the dog base plate (143) is connected to the lower main shaft (12) on the bottom panel (the upper and lower main shafts of the sewing machine (1) rotate synchronously through the link of the toothed belt (13)), wherein the lower main shaft (12) is conjoined to an eccentric shaft (1811) of the other drive mechanism (181) to drive a rocker arm (1812) along with the swing arm shaft (16) swinging in forward and backward reciprocating manner and the dog base plate (141) is further linked to the swing arm (152) via a connecting rod set (15), therefore, when the lower main shaft (12) of the tube base rotates, this initiates the movement of the dog base plate (141) through the swing arm shaft (16) of the lower sub shaft (12') in the drive mechanism (181), along with the pressure from the press foot (17) at the upper extent of the fabric feed needle plate base (14) to conduct the fabric feeding action, and a revolving shuttle (18) connected to a drive mechanism (181) also spins along with the rotating lower main shaft (12) since the drive mechanism (182) in the drive mechanism (182) can transmit the motion to the revolving shuttle (18) to facilitate the descent of the needle holder (111) such that the threads at the inner section of the revolving shuttle (18) and the sewing needle (112) at the bottom end of the needle holder (111) can conduct a stitching routine that achieves the sewing of the object being processed (D); wherein the emphasis is that a horizontally oriented and vertically extended transverse tube-shaped fabric feed needle plate base (14) is disposed at a high position at the central section of the sewing machine (1), as shown in FIG. 9 of the external view of the structure; also referring from FIG. 4 to FIG. 6, the lower main shaft (12) drives a rocker arm (1812) through the eccentric wheel (1811) situated inside the drive mechanism (181) for conducting the dynamic force to the swing arm shaft (16) to swing forward and backward, and to the lower sub shaft (12') rotating in a determined speed and to a drive mechanism (182); furthermore, the bottom end of the dog base plate (141) in the interior section of the fabric feed needle plate base (14) is conjoined to a cam (121) at the tail end of the lower sub shaft (12') in the lower drive mechanism (181); a horizontally oriented slot (142) is formed at the bottom section of the said dog base plate (141) and is inserted with the said cam (121); the body of the dog base plate (141) is vertically inserted into a sliding block base (151)of a connection rod set (15), the two ends of the sliding block base (151) are respectively connected to the swing arms (152, 153); furthermore, the swing arm (152) on one end is conjoined to the swing arm shaft (16), as indicated in FIG. 7, such that when the lower sub shaft (12') rotates, it enables the dog plate base (141) to move up and down through the spin of the cam (121), at the same time, the sliding block base (151) swings forward and backward through the driving of the swing arm (152), thereby the dog plate base (14) slides up and down as well as forward and backward along with the movement of the cam (121) and the sliding block base (151); furthermore, the fabric feed dog (143) is mounted at the top section of the dog base plate (141), such that when the dog base plate (141) moves, it enables the fabric feed dog (143) at the top section to complete the fabric feeding action by making a herringbone stitch and the fabric feed structure of the original level platform-type fabric feed plate base can be extended into the interior section of the transverse tube-shaped-shaped fabric feed needle plate base embodiment of the present invention.

Figure 10:
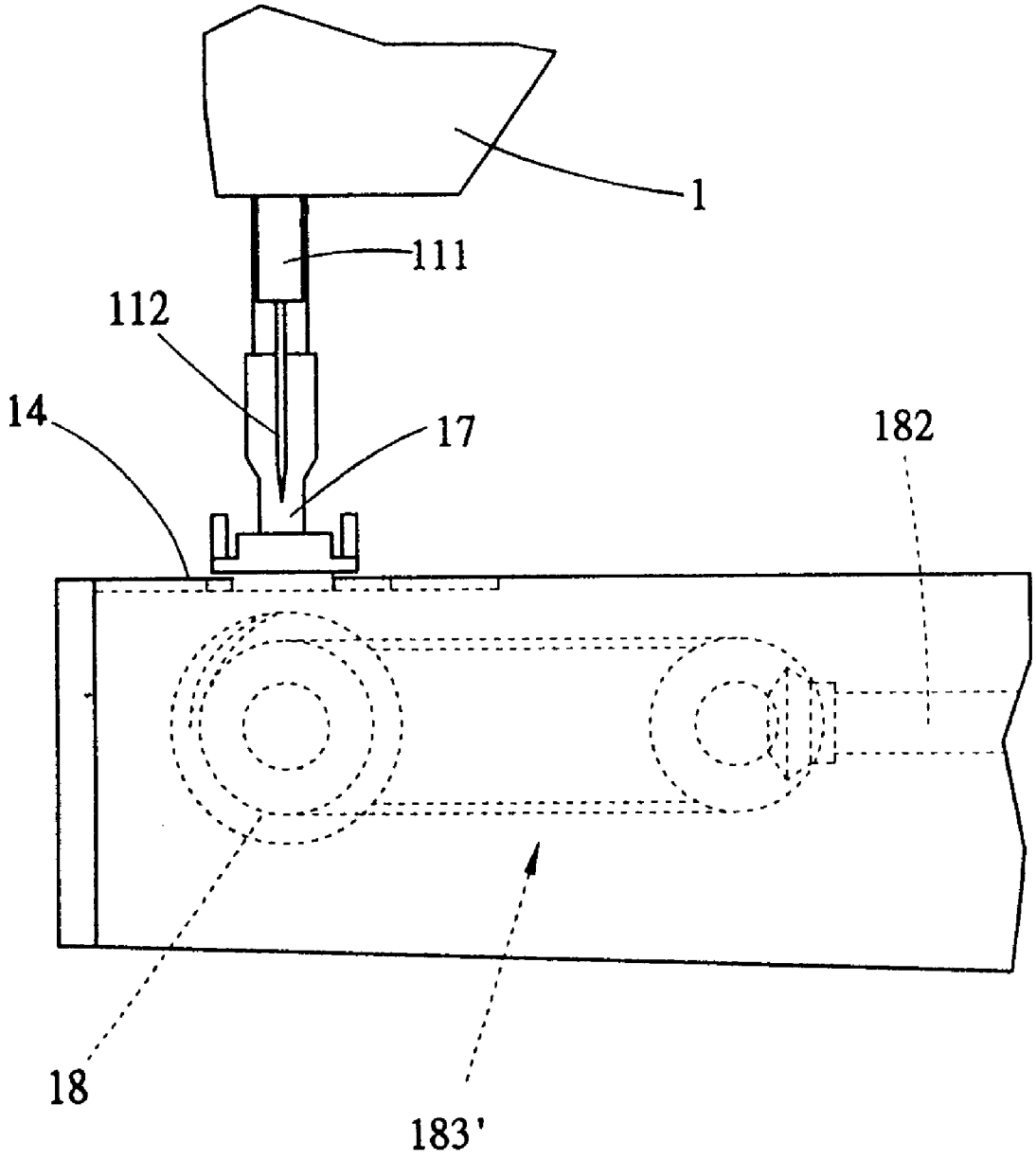
FIG. 10 is an isometric drawing of another embodiment of the driving mechanism of the revolving shuttle of the invention herein.

Additionally, as indicated in FIG. 5, in the interior section of the transverse tube-shaped fabric feed needle plate base (14) is an additional drive mechanism (182) conjoined directly to the drive mechanism (181) on the bottom panel, and a gear set (183) is disposed at the tail end of the drive mechanism (182); through the mesh among all the rotating gears in the gear set (183), the motion can be transmitted to the revolving shaft (184) and drive the revolving shuttle (18) to rotate and the revolving shuttle structure of the original level platform-type fabric feed plate base can be extended into the interior section of the transverse tube-shaped-shaped fabric feed needle plate base embodiment of the present invention. As shown in FIG. 10, within the invention herein, the components utilized to connect the drive mechanism (182) and the revolving shuttle (18) can be replaced by belt wheel set (183') for enabling the revolving shuttle to achieve the same linking effect with the drive mechanism (182).

The invention herein, by having a structure of a horizontally oriented and vertically extended transverse tube-shaped fabric feed needle plate base disposed below the needle holder of the sewing machine and, furthermore, a drive mechanism with the revolving shuttle and the fabric feed tooth plate situated in the interior section of the transverse tube-shaped fabric feed needle plate base for making variation in the type of stitch along with the style of the pattern cam of the sewing machine main body for not only effectively increasing the sturdier sewing and attractive appearance of the objects being processed, but also enhancing the product quality and the productivity of sewing machines in this category, provides a transverse tube-shaped sewing machine of comparatively superior and feasible structure to achieve the purpose of reaching for the high quality, therefore, the present invention is lawfully submitted in application for the granting of the commensurate new patent rights.

What is claimed is:

1. An industrial-use sewing machine structure with transverse tube-shaped needle plate base for making high-speed herringbone stitch is characterized that a transverse tube-shaped fabric feed needle plate base is situated horizontally and vertically extended at a high position at the central section of the sewing machine, and the bottom end of the dog base plate at the interior section of the fabric feed needle plate base is conjoined to the cam at the tail end of the lower sub shaft, the bottom section of the dog base plate is formed as a horizontally oriented slot to be inserted with the said cam and, furthermore, the body of the dog base plate is directly inserted into the sliding block base of a drive mechanism, the two ends of the sliding block base connect respectively with the connecting rod, one connecting rod on one end links to the swing arm.

2. As mentioned in claim 1 of an industrial-use sewing machine structure with transverse tube-shaped needle plate base for making high-speed herringbone stitch, wherein the interior section of the transverse tube-shaped fabric feed needle plate base is directly conjoined to the drive mechanism of the tube base via a drive shaft and a gear set is situated at the tail end of the drive shaft.

3. As mentioned in claim 1 of an industrial-use sewing machine structure with transverse tube-shaped needle plate base for making high-speed herringbone stitch, wherein an eccentric wheel is disposed inside the drive mechanism linked to the lower main shaft for driving the rocker arm to move.

4. As mentioned in claim 1 of an industrial-use sewing machine structure with transverse tube-shaped needle plate base for making high-speed herringbone stitch, wherein, the cam is mounted at the distal end of the sub shaft extended from one side of the drive mechanism.

5. As mentioned in claim 2 of an industrial-use sewing machine structure with transverse tube-shaped needle plate base for making high-speed herringbone stitch, wherein the components utilized for connecting the drive shaft and the revolving shuttle can be a set of toothed belt wheels.

* * * * *